US005231419A

United States Patent [19]

Ryu

[11] Patent Number: 5,231,419

[45] Date of Patent: Jul. 27, 1993

[54] APPARATUS FOR DRIVING A PLATEN ROLL AND A THERMAL PRINT HEAD OF A COLOR VIDEO PRINTER

[75] Inventor: Ji S. Ryu, Seoul, Rep. of Korea

[73] Assignee: Goldstar Co., Ltd., Rep. of Korea

[21] Appl. No.: 807,263

[22] Filed: Dec. 12, 1991

[30] Foreign Application Priority Data

Dec. 18, 1990 [KR] Rep. of Korea ..... 20154/1990

[51] Int. Cl.[5] ..... B41J 25/304

[52] U.S. Cl. ..... 346/76 PH; 400/649

[58] Field of Search ..... 346/76 PH; 400/120 HE, 400/649

[56] References Cited

FOREIGN PATENT DOCUMENTS 0225086 10/1986 Japan ..... 400/120 HE 0283581 12/1986 Japan ..... 400/120 HE

*Primary Examiner*—Benjamin R. Fuller

*Assistant Examiner*—N. Le

*Attorney, Agent, or Firm*—Blakely, Sokoloff, Taylor & Zafman

[57] ABSTRACT

Apparatus for automatically driving a platen roll and a thermal print head of a color video printer. The apparatus comprises a platen lever rotatably mounted on a side portion of a main base by a shaft in order to be capable of turning about the shaft and having a platen roll at an end thereof, a head lever rotatably mounted on the main base near the platen lever by a shaft in order to be capable of turning about the shaft and having a thermal print head at an end thereof, a biasing member for biasing the platen lever, a power transmitting member mounted on the other side portion of the main base for transmitting power from a driving motor, a slide lever engaging with the power transmitting member and being capable of moving along the lengthwise direction of the main base in a rectilinear reciprocating motion in order to cause the platen lever to rotate, a driving lever engaging with the slide lever in order to drive the head lever, and a compression lever engaging with the slide lever in order to compress the head lever. The apparatus of this invention provides advantage in that it improves the operational effect of the color video printer owing to the automatic driving operation for the platen roll and the thermal print head of the printer.

11 Claims, 4 Drawing Sheets

APPARATUS FOR DRIVING A PLATEN ROLL AND A THERMAL PRINT HEAD OF A COLOR VIDEO PRINTER

BACKGROUND OF THE INVENTION

1. Field of the Invention

The present invention relates to a color video printer, and more particularly to an apparatus for automatically driving a platen roll and a thermal print head of such a color video printer, in which the platen roll and the thermal print head are driven by means of a cam and levers mechanism in order to shift between the compressed printing position and the stop position at the same time.

2. Description of the Prior Art

Referring to FIG. 1, known color video printers generally comprise a head lever 1 which has a thermal print head secured to a front end thereof, a manipulating lever 2 for causing the head lever 1 to turn about a turning shaft thereof, a film cassette 4 which is capable of being removably mounted into the printer, and containing therein a film which is used for transcribing color images thereof on printing papers 3, and a platen roll 5 for providing a pressing force for the thermal print head of the head lever 1 in order to press the printing paper 3 and the film of the cassette 4 disposed between the platen roll 5 and the thermal print head.

On the other hand, the platen roll 5 is connected, as shown in FIG. 2, to an end of a platen lever 6 of which the other end has an integrally formed sector gear 7, said sector gear 7 then engages with an intermediate gear 8. The intermediate gear 8 also engages with a driving gear 10 which is secured to a driving shaft of a reversible driving motor 9.

In FIG. 1, the reference numerals 11 and 12 denote a pair of rollers oppositely disposed in order to face with each other for resiliently transmitting the printing papers 3 to the printing position, that is, a pinch roller and a grip roller, respectively.

In operation of the known color video printer of the above construction, upon having mounted the film cassette 4 in a place of the printer, the manipulating lever 2 is first manually manipulated in the counterclockwise direction in order to shift from the stop position shown at the solid line of FIG. 1 to the printing position shown at the phantom line of the drawing. In result, an integrally formed protrusion 2*a* of the manipulating lever 2 downwardly biases the head lever 1, thereby causing the head lever 1 to move from the stop position to the compressed printing position. Thereafter, as the printer is turned on, the printing paper 3 is transmitted to the printing position by virtue of a rolling action of the pinch roller 11 and the grip roller 12. At the same time, the film of the film cassette 4 is disposed at the printing position. In sequence, the driving motor 9 rotates in order to drive the driving gear 10, thereby causing the intermediate gear 8 and the sector gear 7 to rotate. In result, the platen lever 6 rotates clockwise in order to make the platen roll 5 shift upwardly, thereby causing the platen roll 5 to closely contact with the thermal print head of the head lever 1 in order to accomplish the compressed printing standby state.

However, the known color video printer has disadvantage in that it has to be provided with the auxiliary transmitting mechanism for shifting the thermal print head of the head lever 1 and the platen roll 5, thereby causing the construction of the printer to be complex.

Furthermore, the known color video printer has another disadvantage in that the manipulating lever 2 for shifting the head lever 1 has to be manually operated, thereby causing the manipulation therefor to be considerably inconvenient.

SUMMARY OF THE INVENTION

It is, therefore, an object of this invention to provide an apparatus for automatically driving a platen roll and a thermal print head of a color video printer, in which the above-mentioned disadvantage can be overcome, and the platen roll and the thermal print head are automatically driven by using a cam gear and a plurality of actuating levers which sequentially cooperate with the cam gear.

The above-mentioned object of this invention can be accomplished by providing an apparatus for automatically driving a platen roll and a thermal print head of a color video printer comprising: a platen lever rotatably mounted on a side portion of a main base by means of a shaft in order to be capable of turning about the shaft, the platen lever having a platen roll at an end thereof; a head lever rotatably mounted on the main base near the platen lever by means of a shaft in order to be capable of turning about the shaft, the head lever having a thermal print head at an end thereof; biasing member for biasing the platen lever; power transmitting member mounted on the other side portion of the main base for transmitting power from a driving motor; a slide lever engaging with the power transmitting member and being capable of moving along the lengthwise direction of the main base in a rectilinear reciprocating motion in order to cause the platen lever to rotate about the shaft of the platen lever; a driving lever engaging with the slide lever in order to drive the head lever; and a compression lever engaging with the slide lever in order to compress the head lever.

BRIEF DESCRIPTION OF THE DRAWINGS

The above and other objects, features and other advantages of the present invention will be more clearly understood from the following detailed description taken in conjunction with the accompanying drawings, in which:

FIGS. 3 and 4 are front views showing a construction and operation of a driving apparatus for driving a platen roll and a thermal print head of a color video printer in accordance with the present invention, in which:

FIG. 3 is a front view showing a stop mode of the driving apparatus; and

FIG. 4 is a front view showing a compressed printing mode of the driving apparatus.

DETAILED DESCRIPTION OF THE PREFERRED EMBODIMENTS

Figure 1:
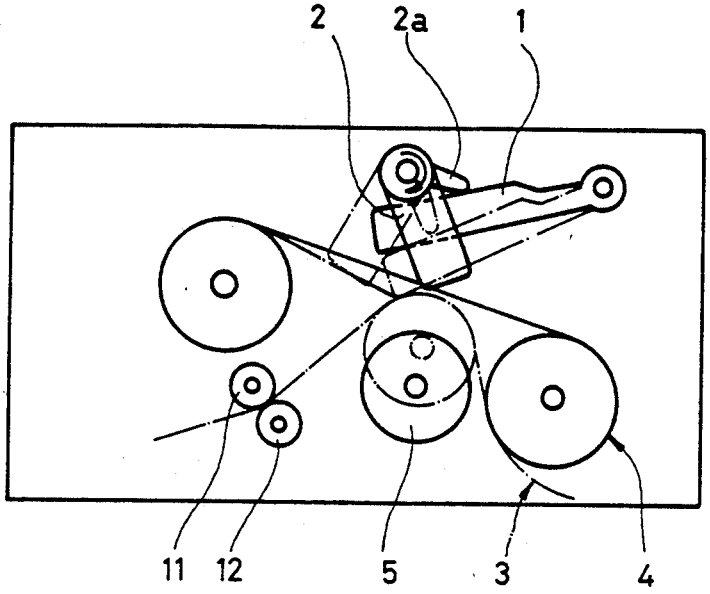
FIG.1 PRIOR ART
FIG. 1 is a schematic view showing a construction of a known color video printer for showing driving mechanism for driving a thermal print head of the color video printer.
Figure 2:
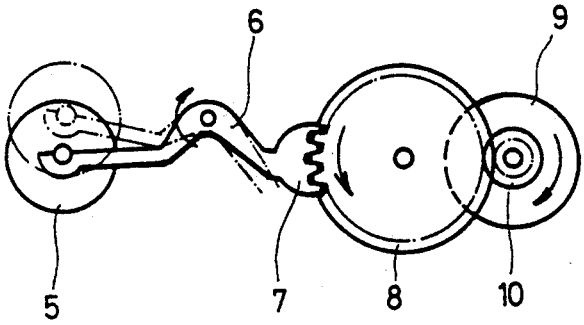
FIG.2 PRIOR ART
FIG. 2 is a schematic view showing a construction of a known driving mechanism for driving a thermal print head of the color video printer of FIG. 1.
Figure 3:
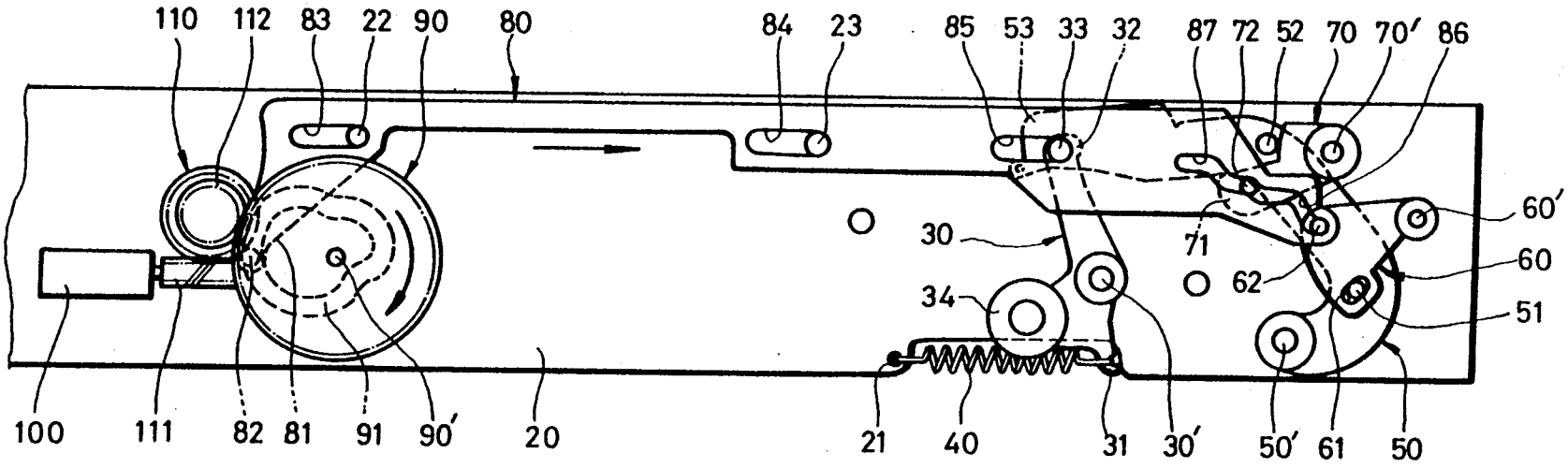
Figure 4:
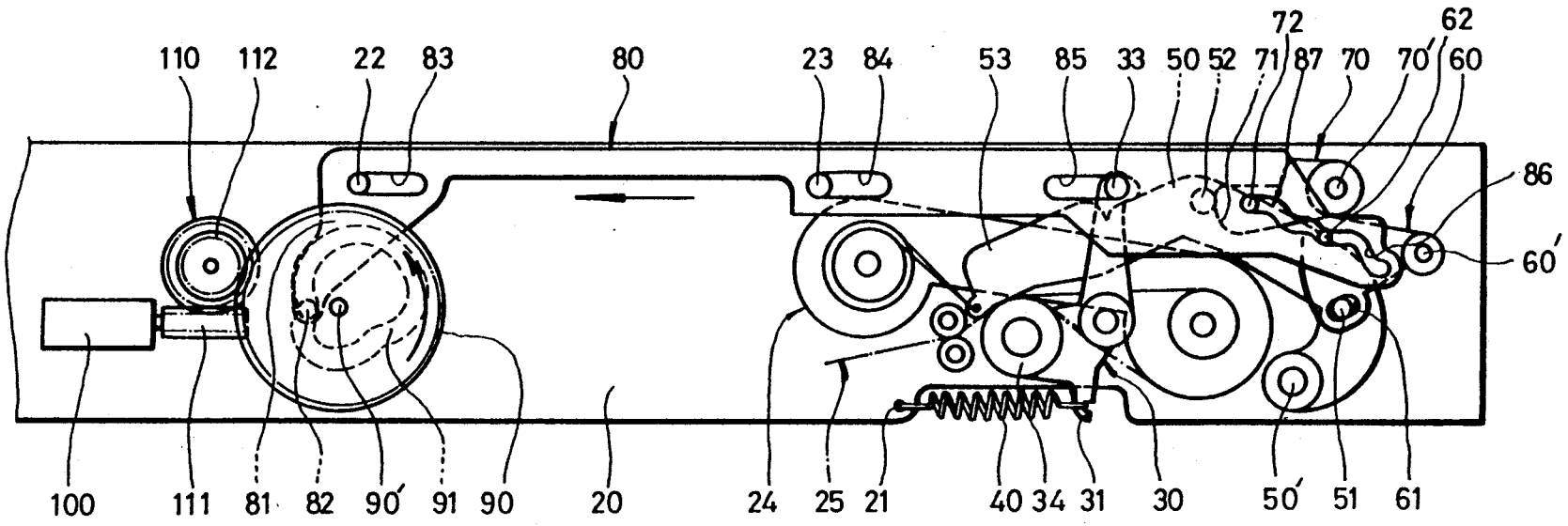
Figure 5:
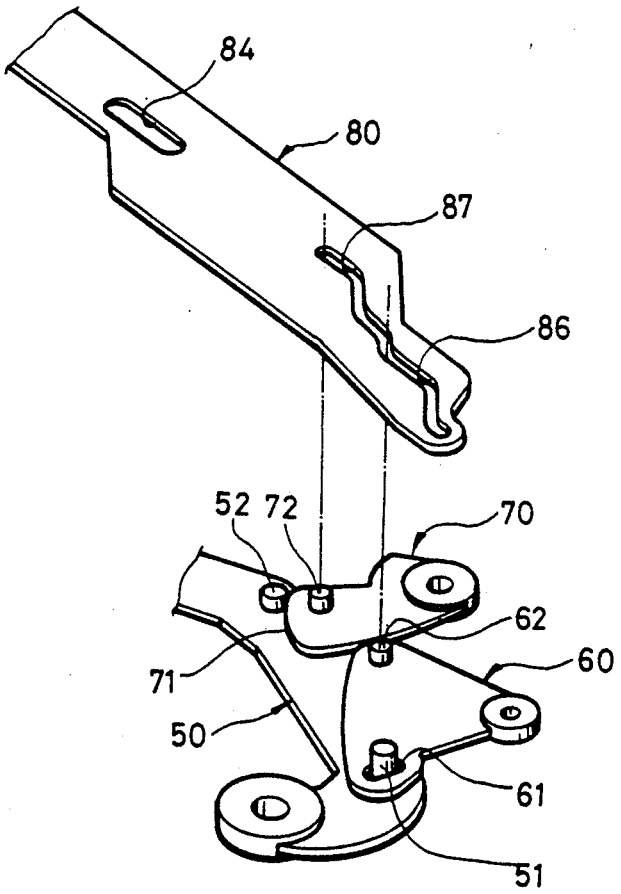
FIG. 5 is an enlarged perspective view of the driving apparatus of FIGS. 3 and 4.

Referring first to FIGS. 3 and 4 which are front views each showing a stop mode and a printing mode of a driving apparatus for driving a platen roll and a thermal print head of a color video printer of this invention, the driving apparatus comprises a generally rectangular main base 20, a platen lever 30 rotatably mounted on a middle portion of the main base 20 in order to be capable of turning about a shaft 30*a*, at an end of which lever 30 a platen roll 30 is secured. A head lever 50 having a thermal print head 53 which is secured to an end thereof is mounted on a side portion of the main base 20 with respect to the locating position of the platen lever 30. On the other hand, the platen lever 30 is always biased in the clockwise direction by means of a biasing member, such as a tensional coil spring 40.

In addition, there are provided a cam gear 90 which is mounted on the other side portion of the main base 20 with respect to the position of the platen lever 30, a reversible driving motor 100 for supplying the driving power for the apparatus. Power transmitting gears 110 engages with the driving motor 100 for transmitting the driving power of the motor 100 to the cam gear 90. The cam gear 90 engages with a slide lever 80 which is capable of moving in a distance along the lengthwise direction of the main base 20 in a rectilinear reciprocating motion in order to cause the platen lever 30 to turn about the shaft 30*a*.

As shown in the drawings, the slide lever 80 engages with a driving lever 60 and a compression lever 70, the one lever 60 adapted for driving the head lever 50 but the other lever 70 adapted for compressing the head lever 50 in order to accomplish the compressed printing state.

In result, the rotating power of the cam gear 90 being generated due to the rotation of the driving motor 100 causes the platen roll 34 and the thermal print head 53 to shift between the printing mode position and the stop mode position thereof, respectively. Additionally, the rotating power of the cam gear 90 causes the thermal printing head 53 of the head lever 50 at the printing mode position to compress the platen roll 34 of the platen lever 30. The cam gear 90 is provided with a non-circular cam slot 91 and rotatably mounted on the main base 20 by means of a shaft 90'.

The power transmitting gears 110 comprises a worm 111 and a double-transmitting gear 112, in which the worm 111 is secured to a driving shaft of the reversible driving motor 100, while the double-transmitting gear 112 comprises two gears having different diameters from each other and secured to each other, the one gear of relatively larger diameter, that is, a worm gear, engaging with the worm 111 but the other gear of relatively smaller diameter engaging with the cam gear 90.

The slide lever 80 is provided with a pair of rectilinear guide slots 83 and 84, each formed at both sides thereof and receiving guide pins 22, 23 which are secured to the main base 20, and a slide guide pin 82 secured at a protruding end 81 thereof. The slide guide pin 82 is movably received in the non-circular cam slot 91 of the cam gear 90. In addition, the slide lever 80 is provided with three actuating guide slots, that is, first to third guide slots 85 to 87. The first actuating guide slot 85 is formed at a position spaced apart from the guide slot 84 in a direction opposite to the position of the guide slot 83 and adapted for driving the platen lever 30, while the second and third actuating guide slots 86 and 87 are formed at positions spaced apart from the first guide slot 85 in the direction opposite to the position of the guide slot 84 and formed as communicating with each other as shown in the drawings. The second slot 86 is adapted for driving the head lever 50 while the third slot 87 is adapted for driving the compression lever 70 in order to compress the thermal print head 53 of the head lever 50 with respect to the platen roll 34.

In addition, the platen lever 30 is rotatably mounted, at a middle portion, on the main base 20 by means of the shaft 30' so that it is capable of turning about the shaft 30*a*. The platen lever 30 has at a lower protruding end thereof a hook 31 for supporting an end of the tensional coil spring 40, the other end of which spring 40 is supported by a hooking hole 21 formed at a lower portion of the main base 20. There is provided, at an upper end of the platen lever 30, an actuating pin 33 which is then received in the first actuating guide slot 85 of the slide lever 80.

Therefore, the platen lever 30 is always biased in order to elastically rotate in the clockwise direction by virtue of the resilient force of the tensional coil spring 40, thereby causing the slide lever 80 to be biased in the rightward direction as shown in FIG. 3.

The head lever 50 has a generally arc shape and is rotatably mounted, at a lower end thereof, on a lower portion of the main base 20 by means of a shaft 50' so that it is capable of turning about the shaft 50'. The head lever 30 has, at a front end thereof, the thermal print head 53 and at both curved portions thereof an actuating pin 51 and a compression pin 52 which are fixed thereto, respectively.

On the other hand, the driving lever 60 has a generally sector form and is rotatably mounted, at a corner thereof, on the main base 20 above a middle portion of the head lever 50 by means of a shaft 60' so that it is capable of turning about the shaft 60'. The driving lever 60 is provided, at another corner thereof, with an actuating hole 61 which receives the actuating pin 51 of the head lever 50, while the lever 60 is provided, at still another corner thereof, with an actuating guide pin 62 which is received in the second actuating guide slot 86.

The compression lever 70 is rotatably mounted, at an end thereof, on the main base 20 by means of a shaft 70' in order to make the other end thereof be disposed between the head lever 50 and the slide lever 80 so that it is capable of turning about the shaft 70'. The compression lever 70 has an actuating pin 72 which is secured to a portion of the other end of the lever 70 and received in the third actuating guide slot 87 of the slide lever 80, said other end of the lever 70 being formed with a contacting surface 71 for selectively contacting with the compression pin 52 of the head lever 50.

In the drawings, the reference numerals 24 and 25 denote a film cassette and continuous printing paper, respectively.

In operation of the present driving apparatus of the color video printer of the above construction, upon having mounted the film cassette 4 in a place of the printer, the printer is then turned on. In result, the driving motor 100 drives the cam gear 90 to rotate in the clockwise direction, as shown in FIG. 3, by the power transmission by the power transmitting gears 110 comprising the worm 111 and the double-transmitting gear 112. Accordingly, the slide guide pin 82 of the slide lever 80 which is received in the non-circular cam slot 91 of the cam gear 90 moves along the cam slot 91 in the sliding motion as the cam gear 90 rotates, thereby causing the slide lever 80 to move in the rightward direction under the condition of movement in the rectilinear reciprocating motion.

Here, in case of the stop mode position, the guide pin 82 of the slide lever 80 is located at a relatively larger diameter position of the cam slot 91 as shown in FIG. 3, while in case of the printing mode position, the slide guide pin 82 is located at a relatively smaller diameter position of the cam slot 91 as shown in FIG. 4. In other words, FIG. 3 shows the stop mode position of the driving apparatus of this invention, while FIG. 4 shows the printing mode position.

Describing in detail the above-mentioned operation of the driving apparatus, upon powering on the printer, the cam gear 90 first rotates in the clockwise direction as shown in FIG. 3 as the driving motor 100 rotates, thereby causing the slide lever 80 to move rightward in the rectilinear reciprocating motion. In result, the actuating pin 62 of the driving lever 60 engaging with the second actuating guide slot 86 of the slide lever 80 upwardly moves along the actuating guide slot 86. Thus, the driving lever 60 clockwise rotates about the shaft 60', in turn, the actuating pin 51 of the head lever 50 which is received in the actuating slot 61 of the driving lever 60 actuates the head lever 50 to rotate in the counterclockwise direction about the shaft 50' so that the head lever 50 shifts from the stop position of FIG. 3 to the printing position of FIG. 4.

At the same time, the first actuating slot 85 of the slide lever 80 moves rightward as the lever 80 moves rightward, so that the actuating pin 33 of the platen lever 30 which is movably received in the first actuating slot 85 tends to be away from the right side end of the first actuating guide slot 85. However, as described above, the platen lever 50 is also biased by means of the tension coiled spring 40 in order to elastically turn about the shaft 30*a* in the clockwise direction, thus the platen lever 50 elastically turns clockwise until the actuating pin 33 stops the movement thereof by contacting with the right side end of the first actuating slot 85 of the slide lever 80. In result, the platen roll 34 secured to the lower end of the platen lever 30 elastically contacts with the thermal print head 53 of the head lever 50 which also shifts from the stop position to the printing position as described above.

On the other hand, as the slide lever 80 moves rightward, the actuating pin 72 of the compression lever 70 upwardly moves along the third actuating guide slot 87, thereby causing the compression lever 70 to rotate clockwise. In result, the contacting surface 71 of the compression lever 70 pushes the compression pin 52 of the head lever 50 leftward and downwardly, so that the thermal print head 53 of the head lever 50 compresses the platen roll 34 of the platen lever 30. Accordingly, the printing mode of the printer is accomplished as shown in FIG. 4.

At the above-mentioned printing mode, the printer carries out the printing operation in which a desired color image of the film is transcribed on the printing paper 25.

Upon accomplishing the printing operation of the printer, the reversible driving motor 100 rotates in the reversed direction in order to drive the cam gear 90 in the counterclockwise direction as shown in FIG. 4, thereby causing the slide lever 80 to move leftward. Hence, the actuating pin 72 of the compression lever 70 moves downwardly along the third actuating slot 87 in order to cause the compression lever 70 to rotate counterclockwise, thus the compression pin 52 of the head lever 50 escapes from the compressed contacting state with the contacting surface 71 of the compression lever 70. In sequence, the actuating pin 62 of the driving lever 60 downwardly moves along the second actuating guide slot 86 of the slide lever 80 in order to cause the driving lever 60 to rotate counterclockwise until it returns to the original position, that is, the stop position shown in FIG. 3. In the same manner, the head lever 50 and the platen lever 30 returns to the stop positions thereof shown in FIG. 3, respectively.

As described above, the platen roll and the thermal print head of the driving apparatus of this invention automatically shifts between the compressed printing position and the stop position at the same time by means of a transmitting mechanism comprising a cam gear and a plurality of cooperating levers. In result, the driving apparatus of this invention provides advantage in that it improves the operational effect of the color video printer owing to the automatic driving for the platen roll and the thermal print head.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. An apparatus for driving a platen roll and a thermal print head of a color video printer comprising:

a main base;

a platen lever rotatably mounted on a platen shaft attached to said main base for turning about said platen shaft, said platen lever having a platen roll connected thereto;

a head lever rotatably mounted on a head shaft attached to said main base adjacent to said platen lever for turning about said head shaft, said head lever having a thermal print head connected thereto;

biasing means for biasing said platen lever;

power transmitting means mounted on said main base for transmitting power from a driving motor;

a slide lever engaging with said power transmitting means for movement in a rectilinear reciprocating motion with respect to said main base in order to cause said platen lever to rotate about said platen shaft;

a driving lever engaging with said slide lever in order to drive said head lever; and a compression lever engaging with the slide lever in order to compress the head lever.

2. The apparatus as claimed in claim 1, wherein said slide lever further comprises:

slide guide means for guiding the rectilinear reciprocating motion of the slide lever with respect to the main base; and driving means for driving the platen lever and the head lever.

3. The apparatus as claimed in claim 2, wherein said slide guide means comprises:

a plurality of guide slots each for receiving a guide pin of the main base; and a slide guide pin mounted on the slide lever and engaging with said power transmitting means.

4. The apparatus as claimed in claim 2, wherein said driving means comprises:

a first actuating guide slot for receiving an actuating pin of the platen lever;

a second actuating guide slot for receiving an actuating pin of the driving lever; and a third actuating guide slot for receiving an actuating pin of the compression lever.

5. The apparatus as claimed in claim 1, wherein said platen lever is connected to the main base by means of the biasing means in order to be biased by means of the biasing means, and has at an upper end thereof an actuating pin which is received in a first actuating guide slot of the slide lever.

6. The apparatus as claimed in claim 1, wherein said head lever has an actuating pin and a compression pin, said actuating pin adapted for being received in an actuating guide slot of the driving lever and said compression pin adapted for contacting with a contacting surface of the compression lever.

7. The apparatus as claimed in claim 1, wherein said biasing means comprises a tensional coil spring of which an end is connected to a hooking hole of the main base and an other end is connected to the platen lever.

8. The apparatus as claimed in claim 1, wherein said power transmitting means comprises:

a cam gear rotatably mounted on the main base and having a cam slot for receiving a slide guide pin of the slide lever; and a transmitting member for transmitting the power of the driving motor to said cam gear.

9. The apparatus as claimed in claim 8, wherein said transmitting member comprises:

a worm rotatably mounted on the driving motor; and a double-transmitting gear engaging with the cam and said worm.

10. The apparatus as claimed in claim 1, wherein said driving lever has an actuating slot and an actuating pin, said actuating slot adapted for receiving an actuating pin of the head lever and said actuating pin adapted for being received in a second actuating slot of the slide lever.

11. The apparatus as claimed in claim 1, wherein said compression lever is mounted on a side portion of the main base and has an actuating pin and a contacting surface, said actuating pin adapted to be received in the third actuating slot of the slide lever and said contacting surface adapted for contacting with a compression pin of the head lever.

* * * * *